US010041712B2

(12) United States Patent
Ishikawa et al.

(10) Patent No.: US 10,041,712 B2
(45) Date of Patent: Aug. 7, 2018

(54) REFRIGERANT DISTRIBUTOR AND REFRIGERATION CYCLE DEVICE EQUIPPED WITH THE REFRIGERANT DISTRIBUTOR

(71) Applicant: Hitachi-Johnson Controls Air Conditioning, Inc., Minato-ku, Tokyo (JP)

(72) Inventors: Masanori Ishikawa, Tokyo (JP); Eiji Ishii, Tokyo (JP); Sachio Sekiya, Tokyo (JP); Shigeyuki Sasaki, Tokyo (JP)

(73) Assignee: Hitachi-Johnson Controls Air Conditioning, Inc., Tokyo (JP)

( * ) Notice: Subject to any disclaimer, the term of this patent is extended or adjusted under 35 U.S.C. 154(b) by 88 days.

(21) Appl. No.: 14/837,861

(22) Filed: Aug. 27, 2015

(65) Prior Publication Data

US 2016/0091231 A1 Mar. 31, 2016

(30) Foreign Application Priority Data

Sep. 29, 2014 (JP) ..... 2014-197754
Mar. 24, 2015 (JP) ..... 2015-060995

(51) Int. Cl.

| | |
|---|---|
| ***F25B 39/02*** | (2006.01) |
| ***F25B 41/00*** | (2006.01) |
| ***F25B 13/00*** | (2006.01) |
| ***F25B 39/04*** | (2006.01) |
| ***F28F 9/02*** | (2006.01) |
| *F28D 1/053* | (2006.01) |

(52) U.S. Cl.

CPC ..... *F25B 41/003* (2013.01); *F25B 13/00* (2013.01); *F25B 39/028* (2013.01); *F25B 39/04* (2013.01); *F28F 9/0265* (2013.01); *F28D 1/05316* (2013.01)

(58) Field of Classification Search

CPC ..... F25B 39/028; F25B 39/02; F25B 41/003; F25B 13/00
USPC ..... 62/525, 504, 498
See application file for complete search history.

(56) References Cited

U.S. PATENT DOCUMENTS

2014/0123696 A1* 5/2014 Kim ..... F25B 13/00 62/498

FOREIGN PATENT DOCUMENTS

JP 2013-2688 A 1/2013

* cited by examiner

*Primary Examiner* — Melvin Jones
(74) *Attorney, Agent, or Firm* — Crowell & Moring LLP

(57) ABSTRACT

A refrigerant distributor includes an inlet pipe, a header pipe to which the inlet pipe has been connected and a plurality of refrigerant pipes connected to one end side of the header pipe which is opposite to the side that the inlet pipe is connected, below the inlet pipe in a vertical direction, and is configured such that a refrigerant which has flown into the header pipe through the inlet pipe is distributed into the plurality of refrigerant pipes. The header pipe is arranged such that a vertical upper side of the header pipe is inclined toward the one end side that the refrigerant pipes are connected. Thereby, it is possible to stably distribute the refrigerant to each refrigerant pipe while suppressing an increase in cost under flow rate conditions ranging from a rated operation condition to a low rotating speed operation condition.

7 Claims, 8 Drawing Sheets

REFRIGERANT DISTRIBUTOR AND REFRIGERATION CYCLE DEVICE EQUIPPED WITH THE REFRIGERANT DISTRIBUTOR

CLAIM OF PRIORITY

The present application claims priority from Japanese Patent application serial no. 2014-197754, filed on Sep. 29, 2014, and Japanese Patent application serial no. 2015-060995, filed on Mar. 24, 2015, the content of which is hereby incorporated by reference into this application.

FIELD OF THE INVENTION

The present invention relates to a refrigerant distributor which distributes a refrigerant to a plurality of branchend refrigerant pipes and a refrigeration cycle device equipped with the refrigerant distributor.

BACKGROUND OF THE INVENTION

In general, the refrigeration cycle device such as an air conditioner, a heat pump type hot-water heater and so forth includes a refrigerant circuit that a compressor, a throttle device such as a motor operated valve and so forth, a condenser and an evaporator are connected together by means of piping. In a refrigeration cycle of the refrigeration cycle device, the refrigerant which circulates through within the refrigerant circuit repetitively absorbs or radiates heat from air, water and so forth which would be objects to be heat-exchanged in a heat exchanger (the condenser and the evaporator).

For example, the heat exchanger of an indoor unit or an outdoor unit of the air conditioner efficiently performs heat transfer between the refrigerant in a refrigerant pipe and air by joining the plurality of refrigerant pipes to fins which configure an air-side heat transfer surface of the heat exchanger. In this structure, it is necessary to distribute the refrigerant to each of the plurality of refrigerant pipes which are arranged in parallel in the heat exchanger of the indoor unit or the outdoor unit. In the refrigerant which flows in the piping of the heat exchanger in the form of a gas-liquid two-phase flow, a difference in density amounts to several score times between the liquid refrigerant and the gas refrigerant and flow velocities of the gas refrigerant and the liquid refrigerant in the gas-liquid two-phase flow are made greatly different from each other. Therefore, in the refrigerant which flows in the form of the gas-liquid two-phase flow, a gas-liquid interface is disordered and flow of the refrigerant becomes complicated and unstable. Therefore, it becomes necessary to stably distribute the refrigerant configured by the two phases of gas and liquid to each of the refrigerant pipes of the heat exchanger of the indoor unit or the outdoor unit at a predetermined distribution ratio such that the refrigerant efficiently acts in the heat exchanger of the indoor unit or the outdoor unit.

In addition, since there are cases where the liquid refrigerant is diverted in the piping due to the action of gravity exerted onto the flowing liquid refrigerant, it is necessary to stably distribute the refrigerant configured by the two phases of gas and liquid to each of the refrigerant pipes of the heat exchanger at the predetermined distribution ratio, taking the influence of the gravity acting on the refrigerant into consideration.

In addition, when a flow rate of the refrigerant attained when operating at a rotational frequency which is less than a rated rotational frequency becomes lower than that attained in a rated operation, the flow velocity of the refrigerant is made different from that attained in the rated operation and the flowing form is changed. Therefore, it is necessary to appropriately distribute the refrigerant configured by the two phases of gas and liquid to each refrigerant pipe in accordance with a fluctuation in rotational frequency, by taking the above-mentioned matters into consideration.

A refrigerant distributor described in Patent Literature 1 (Japanese Patent Application Laid-Open No. 2013-002688) is of the type that a header pipe which is installed in a vertical direction is provided as a distribution unit and a plurality of pieces of piping (flat tubes) are installed horizontally relative to the header pipe. A concentric or spiral rib is provided in the header pipe as a refrigerant guiding structure, and thereby mixing of the gas refrigerant with the liquid refrigerant is promoted and uniform distribution of the refrigerant is attained.

Patent Literature 1: Japanese Patent Application Laid-Open No. 2013-002688

In the refrigerant distributor described in the above-mentioned Patent Literature 1, when the flow rate of the liquid refrigerant is low, the liquid refrigerant is liable to flow along a wall surface of the refrigerant guiding structure due to a reduction in flow velocity of the liquid refrigerant. For this reason, mixing of the gas refrigerant with the liquid refrigerant is not promoted and almost no effect of uniformly distributing the refrigerant to each of the plurality of pieces of piping (the refrigerant pipes) on the downstream side is obtained. Accordingly, such a disadvantage arises that the performance of the refrigerant distributor at the low flow rate is considerably reduced. In addition, the structure in the header pipe is considerably complicated and the production cost is increased.

The present invention has been made in view of the above-mentioned circumstance and aims to provide a refrigerant distributor making it possible to stably distribute the refrigerant to each of the refrigerant pipes while suppressing an increase in cost under flow rate conditions ranging from a rated operation condition to a low rotational frequency operation condition and a refrigerant cycle device using the above-mentioned refrigerant distributor.

SUMMARY OF THE INVENTION

According to one embodiment of the present invention, there is provided a refrigerant distributor which includes an inlet pipe, a header pipe to which the inlet pipe has been connected and a plurality of refrigerant pipes connected to one end side of the header pipe which is opposite to the side that the inlet pipe is connected, below the inlet pipe in a vertical direction, and is configured such that a refrigerant which has flown into the header pipe through the inlet pipe is distributed into the plurality of refrigerant pipes. The header pipe is arranged such that a vertical upper side of the header pipe is inclined toward the one end side that the refrigerant pipes are connected.

According to the present invention, it is possible to provide the refrigerant distributor making it possible to stably distribute the refrigerant to each of the refrigerant pipes while suppressing an increase in cost under the flow rate conditions ranging from the rated operation condition to the low rotational frequency operation condition and the refrigerant cycle device using the above-mentioned refrigerant distributor.

DETAILED DESCRIPTION OF THE PREFERRED EMBODIMENTS

In the following, specific embodiments of the refrigerant distributor and a refrigerant cycle device including this refrigerant distributor will be described by using the appended drawings. The same numerals are assigned to the same or corresponding parts in the respective drawings.

The refrigerant distributor according to one embodiment of the present invention includes an inlet pipe, a header pipe to which the inlet pipe has been connected and a plurality of refrigerant pipes connected to one end side of the header pipe which is opposite to the side that the inlet pipe is connected, below the inlet pipe in a vertical direction, and is configured such that a refrigerant which has flown into the header pipe through the inlet pipe is distributed into the plurality of refrigerant pipes. The header pipe is arranged such that a vertical upper side of the header pipe is inclined toward the one end side that the refrigerant pipes are connected. According to the refrigerant distributor of one embodiment of the present invention, the header pipe is arranged such that the vertical upper side of the header pipe is inclined toward the one end side to which the refrigerant pipes have been connected. Thereby, it is possible to stably distribute the refrigerant to each refrigerant pipe while suppressing an increase in cost and generation of an energy loss still under the flow rate conditions ranging from the rated operation condition to the low rotating velocity operation condition.

First Embodiment

A first embodiment of the present invention will be described by using FIG. 1 to FIG. 3. First, the domestic air conditioner as the refrigeration cycle device to which the refrigerant distributor according to the present embodiment is applied will be described. Then, the refrigerant distributor according to the present embodiment will be described.

Figure 1:
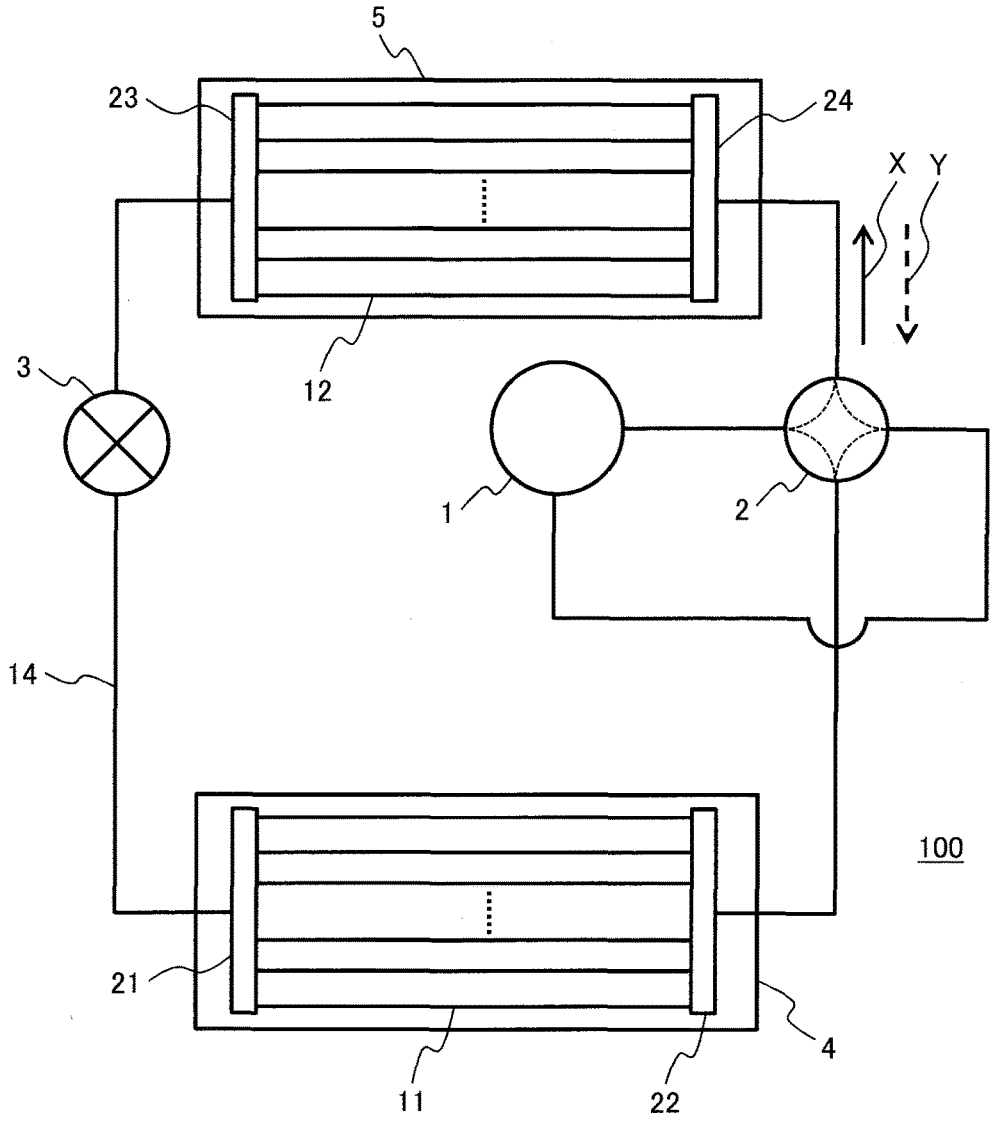
FIG. 1 is a diagram illustrating one example of a refrigerant circuit of a refrigerant cycle device (a domestic air conditioner) according to a first embodiment of the present invention.

FIG. 1 is a diagram illustrating one example of a refrigerant circuit of a domestic air conditioner 100 as the refrigeration cycle device according to the first embodiment. As illustrated in FIG. 1, the domestic air conditioner (hereinafter, referred to as the "air conditioner") 100 according to the present embodiment has a general configuration. That is, a compressor 1, a four-way valve 2, a cooling/heating throttle device 3 such as a motor operated valve and so forth, an indoor heat exchanger 4, an outdoor heat exchanger 5 and so forth are annularly connected together by means of refrigerant piping 14.

The air conditioner 100 performs a cooling operation that the indoor heat exchanger 4 is used as an evaporator and the outdoor heat exchanger 5 is used as a condenser and a heating operation that the indoor heat exchanger 4 is used as the condenser and the outdoor heat exchanger 5 is used as the evaporator by switching the four-way valve 2. Incidentally, in FIG. 1, a solid-lined arrow X denotes a refrigerant circulating direction in the cooling operation and a broken-lined arrow Y denotes a refrigerant circulating direction in the heating operation.

For example, in the air conditioner 100 in the cooling operation, a high-temperature and high-pressure refrigerant which has been compressed by the compressor 1 flows into the outdoor heat exchanger 5 through the four-way valve 2 and radiates heat by heat exchange with air and is condensed. Then, the refrigerant is isenthalpic-expanded by the cooling/heating throttle device 3 and is formed into a low-temperature and low-pressure gas-liquid two-phase flow that the liquid refrigerant and the gas refrigerant are mixed together and flows into the indoor heat exchanger 4. Then, the liquid refrigerant which has flown into the indoor heat exchanger 4 vaporizes to the gas refrigerant by an action of absorbing heat from air through refrigerant pipes 11 and fins (not illustrated) attached to the refrigerant pipes 11. That is, the indoor heat exchanger 4 cools ambient air when the liquid refrigerant vaporizes and thereby the air conditioner 100 exhibits a cooling function.

The refrigerant which has flown out of the indoor heat exchanger 4 returns to the compressor 1 and is compressed to a high-temperature and high-pressure state and flows into the outdoor heat exchanger 5 through the four-way valve 2. In the outdoor heat exchanger 5, the refrigerant is liquefied to the liquid refrigerant through the refrigerant pipes 12 and the fins (not illustrated) attached to the refrigerant pipes 12. Then, the liquid refrigerant circulates through the cooling/heating throttle device 3 and the indoor heat exchanger 4. A refrigeration cycle is configured by repeating such circulation of the refrigerant. Incidentally, although the general configuration of the air conditioner 100 as mentioned above is described, application of the present invention is not limited to the above-mentioned configuration.

Figure 2:
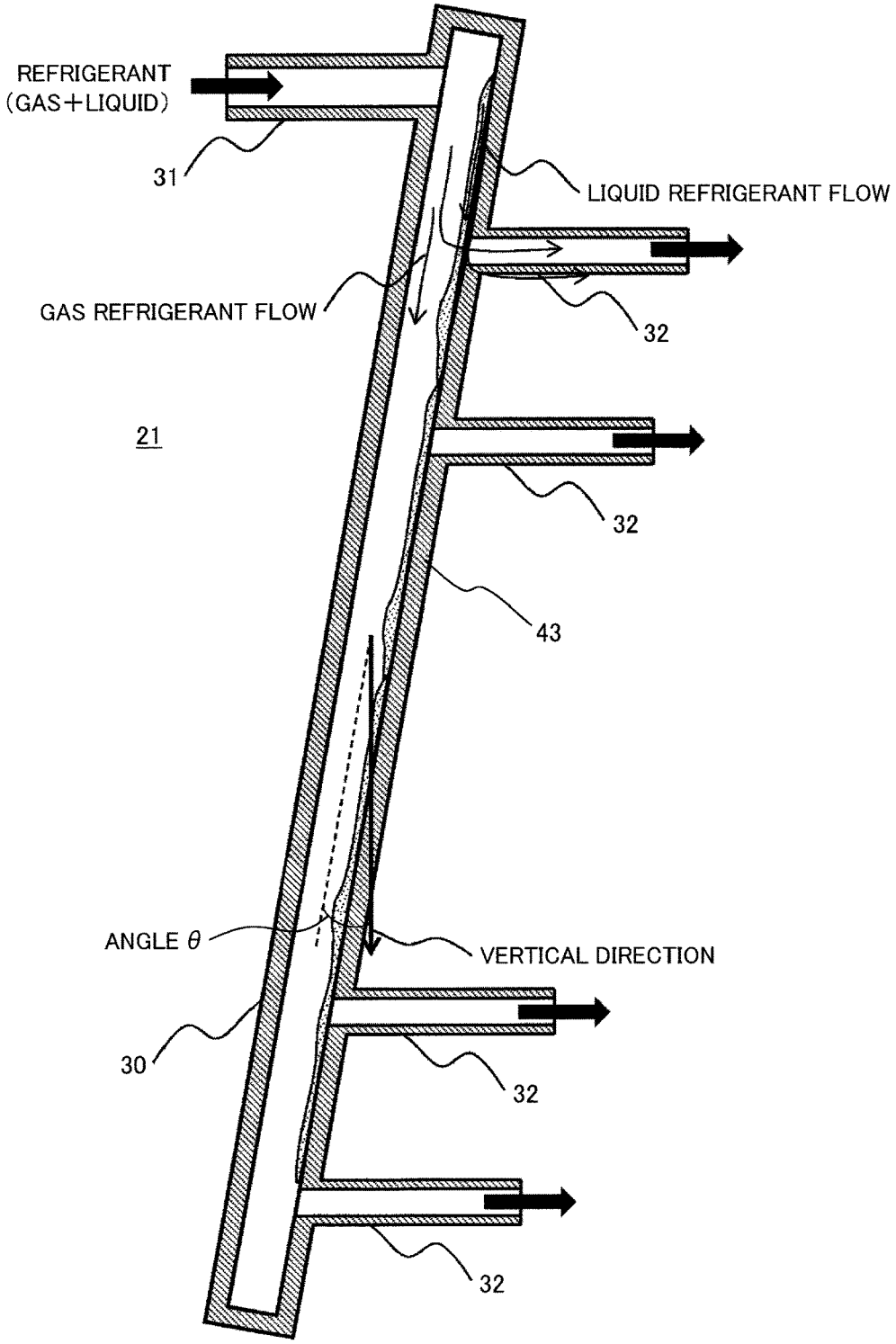
FIG. 2 is a sectional diagram illustrating one example of a refrigerant distributor according to the first embodiment of the present invention.

FIG. 2 is a sectional diagram illustrating one example of a configuration of the refrigerant distributor according to the first embodiment. The refrigerant distributor according to the present embodiment is applied to at least any of refrigerant distributors 21 to 24 included in the indoor heat exchanger 4 and the outdoor heat exchanger 5 into which the gasp-liquid two-phase flow that the gas refrigerant and the liquid refrigerant are mixed together flows depending on a cooling/heating operation mode. In the following, the refrigerant distributor 21 will be representatively described.

The refrigerant distributor 21 according to the present embodiment includes a header pipe 30, an inlet pipe 31 through which the refrigerant that the gas refrigerant and the liquid refrigerant are mixed together flows in, and a plurality of refrigerant pipes 32 through which the refrigerant flows out. The fins (not illustrated) are connected to the refrigerant pipes 32. The plurality of refrigerant pipes 32 are connected to the header pipe 30 on the opposite side of the inlet pipe 31, below the inlet pipe 31 in a vertical direction. Each of the header pipe 30, the inlet pipe 31 and the refrigerant pipes 32 is configured by a pipe of a metal material which is high in thermal conductivity such as copper and so forth. The inlet pipe 31 and the refrigerant pipes 32 are connected to the header pipe 30 by brazing, welding and so forth so as to form a refrigerant flow path in the header pipe 30.

Here, as a structure for guiding the liquid refrigerant toward the refrigerant pipe 32 side, the upper side of the header pipe 30 is installed with an inclination of an inclination angle θ relative to the vertical direction as a reference toward a one-end side 43 (an inlet side of the refrigerant pipe 32 through which the refrigerant flows from the header pipe 30 into the refrigerant pipe 32) which is the side of a connection part between each of the refrigerant pipes 32 and the header pipe 30. That is, the header pipe 30 is arranged such that the vertical upper side of the header pipe 30 is inclined toward the one-end side 43 that the refrigerant pipes 32 are connected.

By arranging the header pipe 30 with an inclination in this way, the liquid refrigerant which flows through within the header pipe 30 comes to flow more toward the inner wall surface on the inlet side of the refrigerant pipe 32 in the inside of the header pipe 30 than it flows toward other parts. Consequently, since the liquid refrigerant comes to be distributed also to the refrigerant pipe 32 connected to an upper part of the header pipe 30, that the liquid refrigerant flows downward through the inside of the header pipe 30 and builds up on a lower part of the header pipe 30 is suppressed and it is possible to improve uneven distribution of the refrigerant into the plurality of refrigerant pipes 32.

Figure 3:
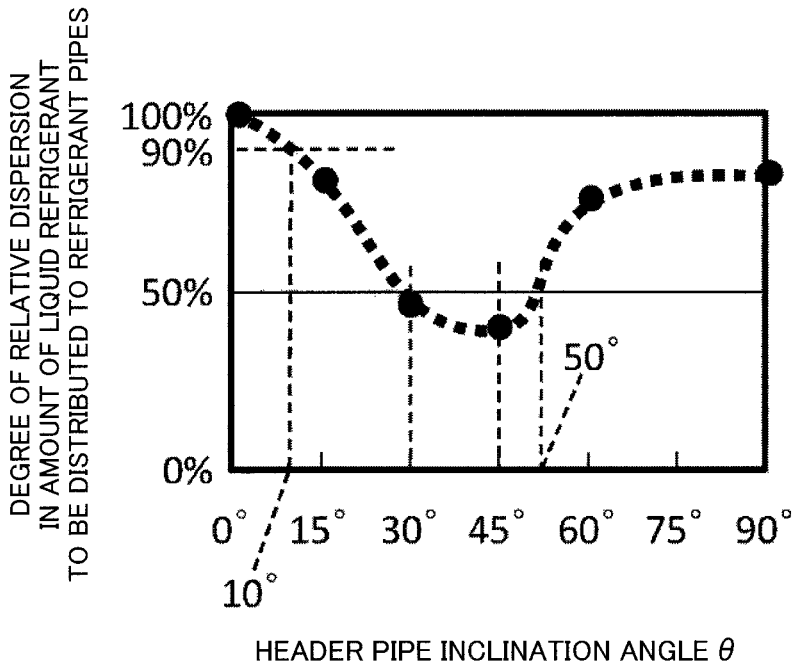
FIG. 3 is an explanatory diagram illustrating one example of an effect of reducing the degree of relative dispersion in amount of the liquid refrigerant to be distributed to refrigerant pipes.

An example of a relation (a result of numerical simulation) between an inclining angle (the inclination angle) θ of the header pipe 30 and a degree of relative dispersion in amount of the liquid refrigerant to be distributed to the plurality of refrigerant pipes 32 is illustrated in FIG. 3.

As illustrated in FIG. 3, it became possible to confirm an effect of reducing the degree of relative dispersion in amount of the refrigerant to be distributed of at least about 10% within a range from at least about 10° to not more than about 90° in inclination angle θ of the header pipe 30. Accordingly, it is preferable that the inclination angle θ of the header pipe 30 be set to at least about 10° and not more than about 90°.

Here, taking an amount of reduction in the degree of relative dispersion in amount of the refrigerant to be distributed into consideration, it is more preferable that the degree of relative dispersion is not more than about 50%. Accordingly, from such viewpoint, it is more preferable that the inclination angle θ of the header pipe 30 be at least about 30° and not more than about 50°.

On the other hand, at the inclination angle θ of the header pipe 30 which is at least about 45°, the degree of relative dispersion in amount of the refrigerant to be distributed is increased. In addition, when the inclination angle θ of the header pipe 30 is increased, a larger installation area becomes necessary. Accordingly, it is desirable that the inclination angle θ of the header pipe 30 be not more than about 45° (if the same effect is obtained, it will be preferable to make the inclination angle θ of the header pipe 30 as small as possible, and for example, when comparing about 30° with about 50° at the degree of relative dispersion of about 50%, about 30° is more preferable). Accordingly, from such viewpoint, it is more preferable that the inclination angle θ of the header pipe 30 be at least about 10° and not more than about 45°.

Further, taking the effect of reducing the degree of relative dispersion in amount of the refrigerant to be distributed (the degree of dispersion of not more than about 50%) and the installation area into consideration, it is the most preferable that the inclination angle θ of the header pipe 30 be at least about 30° and not more than about 45°.

Second Embodiment

Next, a refrigerant distributor according to a second embodiment of the present invention will be described by using FIG. 4. In the present embodiment, the header pipe 30 includes a projection part 34 which projects from an inner wall surface of the header pipe 30 between the inlet pipe 31 and the refrigerant pipe 32, and the projection part 34 includes an inclined part which is inclined downward in the vertical direction toward the one-end side 43 of the header pipe 30 to which the refrigerant pipes 32 are connected. In the present embodiment, the projection pat 34 is formed on the whole circumference of the inner wall surface of the header pipe 30.

Figure 4:
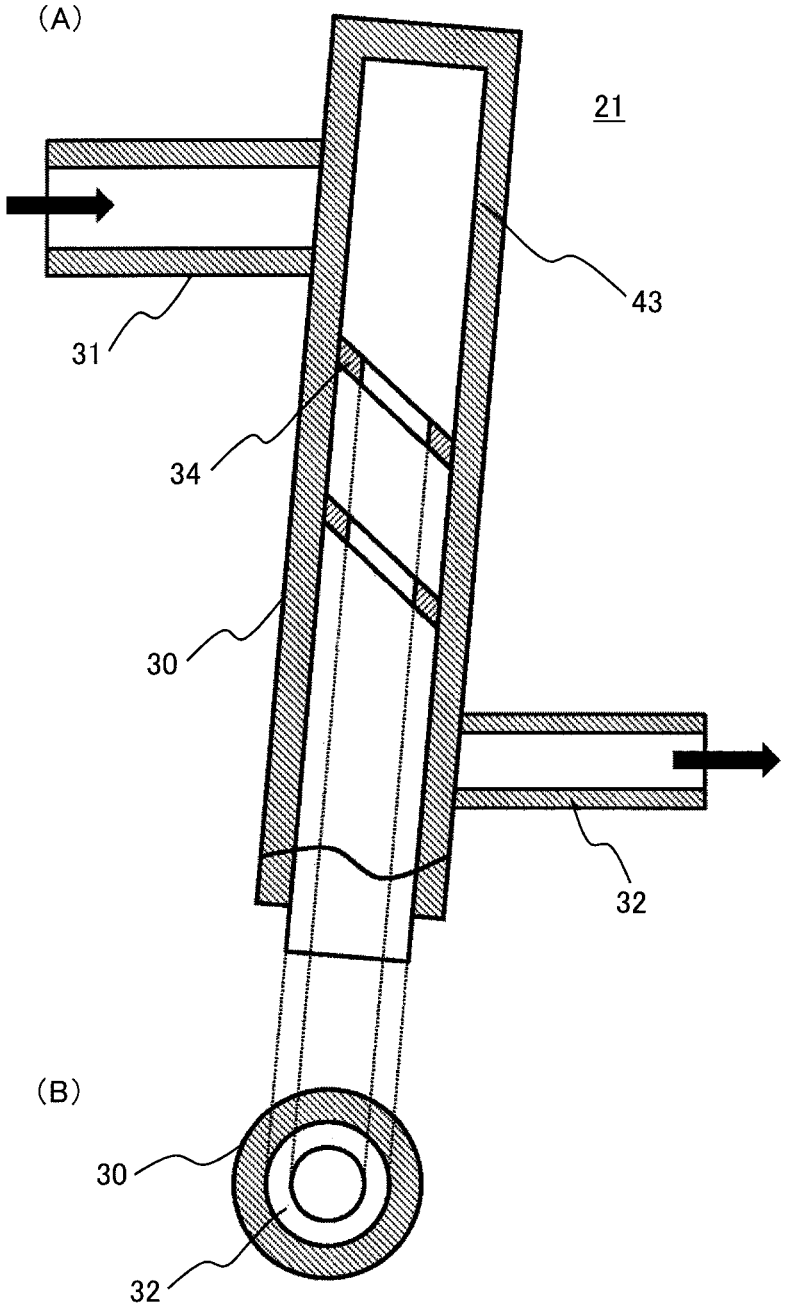
FIG. 4 is a sectional diagram illustrating one example of a refrigerant distributor according to an embodiment 2.

FIG. 4 is a sectional diagram illustrating one example of the refrigerant distributor 21 according to the second embodiment. FIG. 4(A) is an enlarged sectional diagram illustrating one example of a section of the refrigerant distributor 21 corresponding to an upper part of the header pipe 30, and the inlet pipe 31 and the refrigerant pipe 32 which are connected to the header pipe 30. FIG. 4(B) is a diagram illustrating one example of the shape of the inside of the header pipe 30 viewed from the longitudinal direction of the header pipe 30.

In the present embodiment, the aforementioned projection part 34 is installed on the inner wall surface of the header pipe 30 between the downstream side of the refrigerant flow of the inlet pipe 31 and the upstream side of the refrigerant pipe 32. The projection part 34 is installed so as to project from the inner wall surface of the header pipe 30 and is configured to downward incline toward the side of the connection part between the refrigerant pipe 32 and the header pipe 30. The projection part 34 is formed in a whole circumferential direction of the inner wall surface of the header pipe 30 and it is desirable that a projection amount of the projection part 34 be almost equal to a thickness with which the liquid refrigerant flows in the form of a liquid film along the inner wall surface of the header pipe 30. Incidentally, there is no limitation on the number of the projection parts 34 to be installed. One projection part 34 may be installed and the plurality of projection parts 34 may be installed as illustrated in FIG. 4.

The liquid refrigerant which flows through within the header pipe 30 with the aid of the projection part 34 flows more toward the inner wall surface on the inlet side of the refrigerant pipe 32 in the inside of the header pipe 30 than it flows toward other parts. Consequently, since the liquid refrigerant comes to be distributed also to the refrigerant pipe 32 which is connected to the upper part of the header pipe 30, that the liquid refrigerant flows downward in the inside of the header pipe 30 and builds up on the lower part of the header pipe 30 is suppressed and it is possible to improve uneven distribution of the refrigerant into the plurality of refrigerant pipes 32.

As one method of forming the projection part 34, the projection part 34 is formed by fixing the projection part 34 to a part which will configure an inner surface of a long plate-shaped metal plate by cutting, brazing, welding or the like and end faces of the metal plates are mutually fixed by brazing, welding or the like. Thus, it is possible to form the metal plates into the shape of a pipe which includes the projection part 34 by mutually fixing the end faces of the metal plates by brazing, welding or the like. Alternatively, an upper part of the header pipe 30 which includes the projection part 34 may be formed as a separate metal component including insertion parts into which the inlet pipe 31 and the header pipe 30 are to be inserted may be formed, the projection part 34 may be formed in the upper part, and thereafter the inlet pipe 31 and the header pipe 30 may be inserted into the insertion part and fixed by brazing, welding or the like. In that occasion, a component concerned is divided into a plurality of components, the projection part 34 is fixed to each divided component by cutting, brazing, welding or the like, thereafter, all of the divided components are fixed together by brazing, welding or the like and thereby it is possible to form the projection part 34.

As a simpler method, the projection part 34 is formed from a metal thin plate of the same material as that of the header pipe 30 such as copper and so forth by punching and so forth and the metal thin plate is rolled into the form of a roll. Then, the rolled metal thin plate in which an opening is formed so as not to block the flow of the refrigerant through the inlet pipe 31 is inserted into the header pipe 30 from above, the metal thin plate is fixed by brazing, welding or the like and an upper end part of the header pipe 30 is sealed and thereby it is possible to form the projection part 34.

Further, in addition to the projection part 34 according to the present embodiment, it is possible to divert the liquid refrigerant toward the side of the connection part between the refrigerant pipe 32 and the header pipe 30 with the aid of the projection part 34 by installing the header pipe 30 with an inclination as described in the embodiment and it is possible to more divert the liquid refrigerant toward the side of the connection part between the refrigerant pipe 32 and the header pipe 30 by inclining the header pipe 30. Therefore, even when the inclination angle θ (see FIG. 2) of the header pipe 30 is small, it is possible to reduce uneven distribution of the liquid refrigerant into the plurality of refrigerant pipes 32. Accordingly, since it is possible to make the inclination angle θ of the header pipe 30 small, it is possible to install the refrigerant distributor including the header pipe 30 in a smaller space.

Third Embodiment

Next, a refrigerant distributor according to a third embodiment of the present invention will be described by using FIG. 5. In the present embodiment, in particular, the projection part 34 is of the type which includes a notched part 40 above the connection part between the refrigerant pipe 32 and the header pipe 30 in the longitudinal direction of the header pipe 30.

Figure 5:
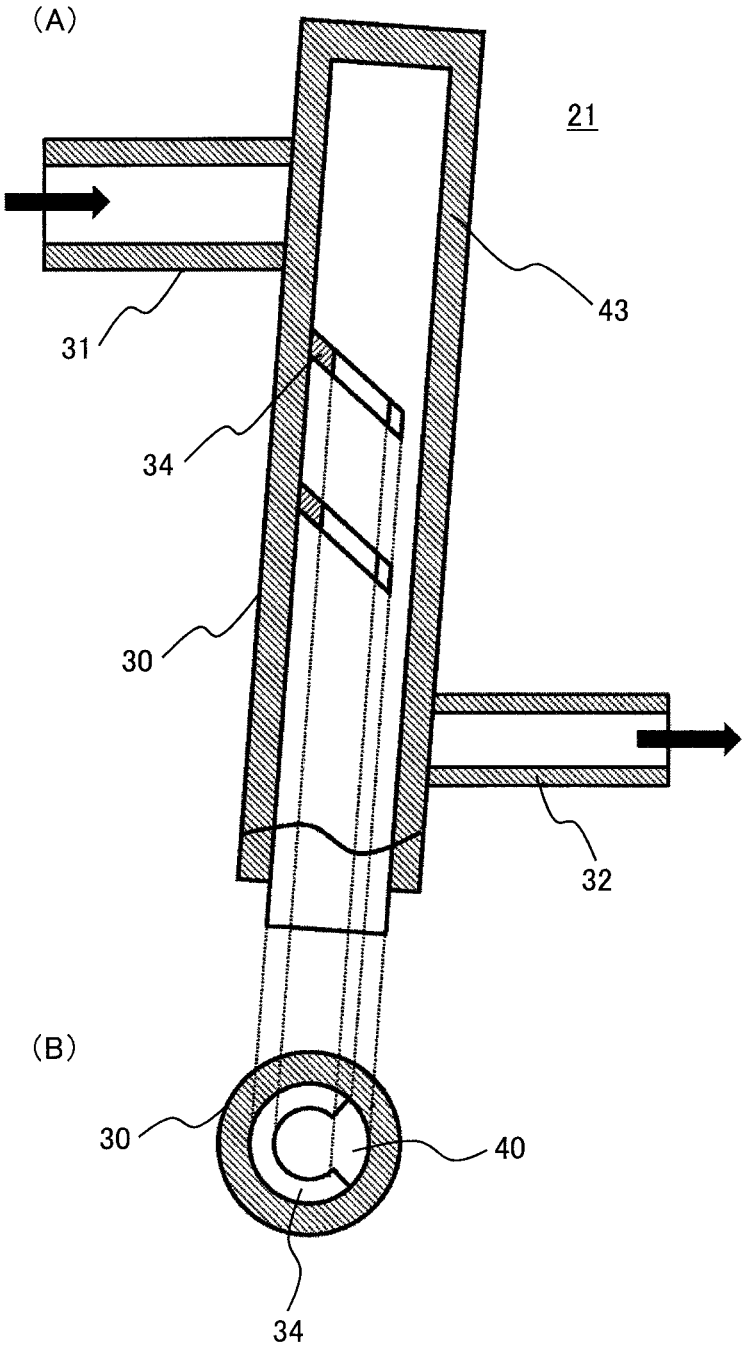
FIG. 5 is a sectional diagram illustrating one example of a refrigerant distributor according to an embodiment 3.

FIG. 5 is a sectional diagram illustrating one example of the refrigerant distributor 21 according to the third embodiment. FIG. 5(A) is an enlarged sectional diagram illustrating one example of the section of the refrigerant distributor 21 corresponding to the upper part of the header pipe 30, and the inlet pipe 31 and the refrigerant pipe 32 which are connected to the header pipe 30. FIG. 5(B) is a diagram illustrating one example of the shape of the inside of the header pipe 30 viewed from the longitudinal direction of the header pipe 30. The refrigerant distributor according to the third embodiment is of the type that another type projection part 34 of a configuration different from the configuration of the projection part 34 in the second embodiment is installed as illustrated in FIG. 5(B).

As illustrated in FIG. 5(B), in the present embodiment, the projection part 34 is not formed in the whole circumferential direction of the inner wall of the header pipe 30 and the notched part 40 is formed above the inlet part of the refrigerant pipe 32. Although a width of the notched part 40 may be set to an optional value, desirably, the width is made larger than an internal diameter of the refrigerant pipe 32. Since the projection part 34 is formed with a downward inclination toward the side of the connection part between the refrigerant pipe 32 and the header pipe 30 and the notched part 40 is formed above the inlet part of the refrigerant pipe 32, the liquid refrigerant flows intensively toward the side of the connection part between the refrigerant pipe 32 and the header pipe 30. According to the present embodiment, even when a falling velocity of the liquid refrigerant which flows along the inner wall surface of the header pipe 32 is fast, it is possible to suppress detachment of the flow of the liquid refrigerant on the upstream side of the refrigerant pipe 32 from the inner wall surface of the header pipe 30.

Fourth Embodiment

Next, a refrigerant distributor according to a fourth embodiment of the present invention will be described by using FIG. 6. In the present embodiment, in particular, the projection part 34 is formed such that a projection width 41 of the projection part 34 on the one-end side 43 to which the refrigerant pipe 32 is connected is made smaller than a projection width 42 of the projection part 34 on the side opposite to the one-end side 43.

Figure 6:
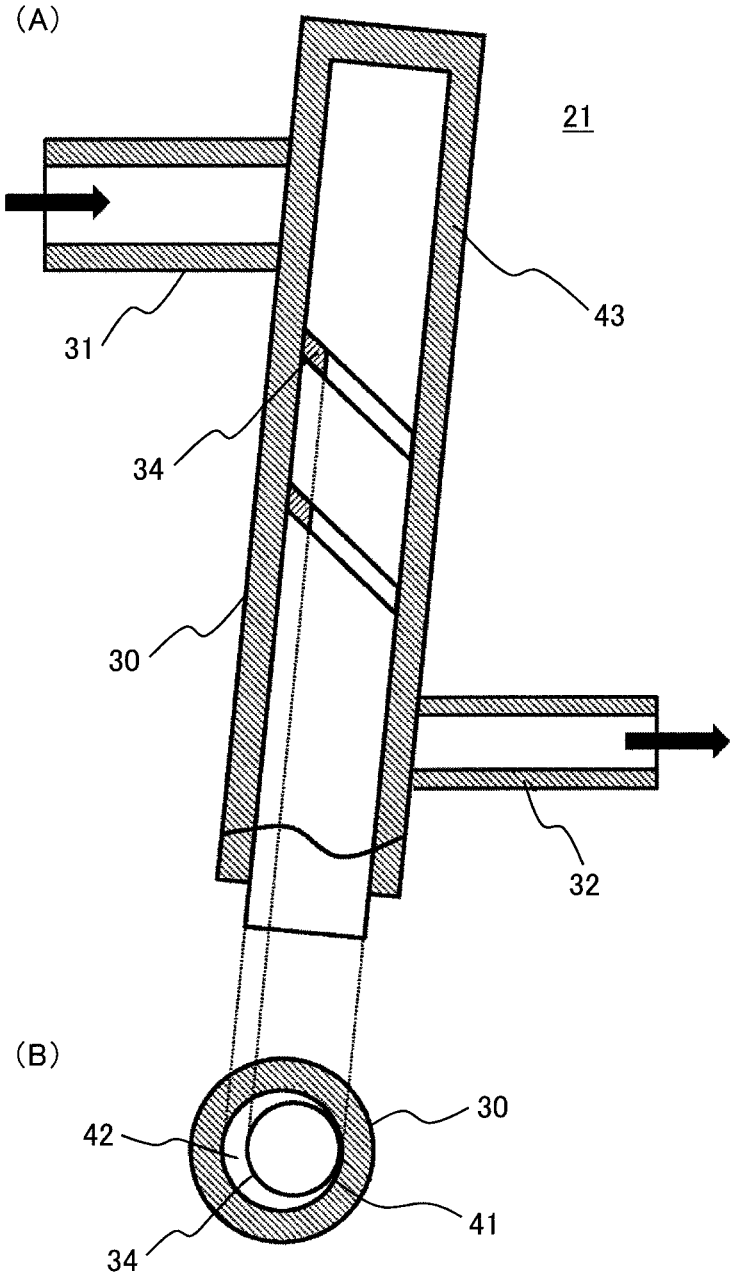
FIG. 6 is a sectional diagram illustrating one example of a refrigerant distributor according to an embodiment 4.

FIG. 6 is a sectional diagram illustrating one example of the refrigerant distributor 21 according to the fourth embodiment. FIG. 6(A) is an enlarged sectional diagram illustrating one example of the section of the refrigerant distributor 21 corresponding to the upper part of the header pipe 30, and the inlet pipe 31 and the refrigerant pipe 32 which are connected to the header pipe 30. FIG. 6(B) is a diagram illustrating one example of the shape of the inside of the header pipe 30 viewed from the longitudinal direction of the header pipe 30. In the fourth embodiment, further another type projection part 34 of a configuration which is different from the configurations of the projection parts 34 in the second and third embodiments is installed as illustrated in FIG. 6(B).

That is, the projection part 34 in the fourth embodiment is not of the type that the projection part 34 is formed on the inner wall of the header pipe 30 so as to be uniform in projection amount (a projection width) in the circumferential direction and is but of the type that the projection part 34 is formed so as to have an uneven projection amount in the circumferential direction, for example, in such a manner that the projection amount on the inlet side of the refrigerant pipe 32 is made small. In addition, also in the present embodiment, since the projection part 34 is formed with a downward inclination toward the side of the connection part between the refrigerant pipe 32 and the header pipe 30, the liquid refrigerant flows intensively toward the side of the connection part between the refrigerant pipe 32 and the header pipe 30 and the flow of the liquid refrigerant which flows downward along the inner wall surface of the header pipe 30 collides with the projection part 34. Therefore, in particular, even when the falling velocity of the liquid refrigerant which flows along the inner wall surface of the header pipe 32 is fast, it is possible to suppress detachment of the flow of the liquid refrigerant on the upstream side of the refrigerant pipe 32 from the inner wall surface of the header pipe 30.

Fifth Embodiment

Figure 7:
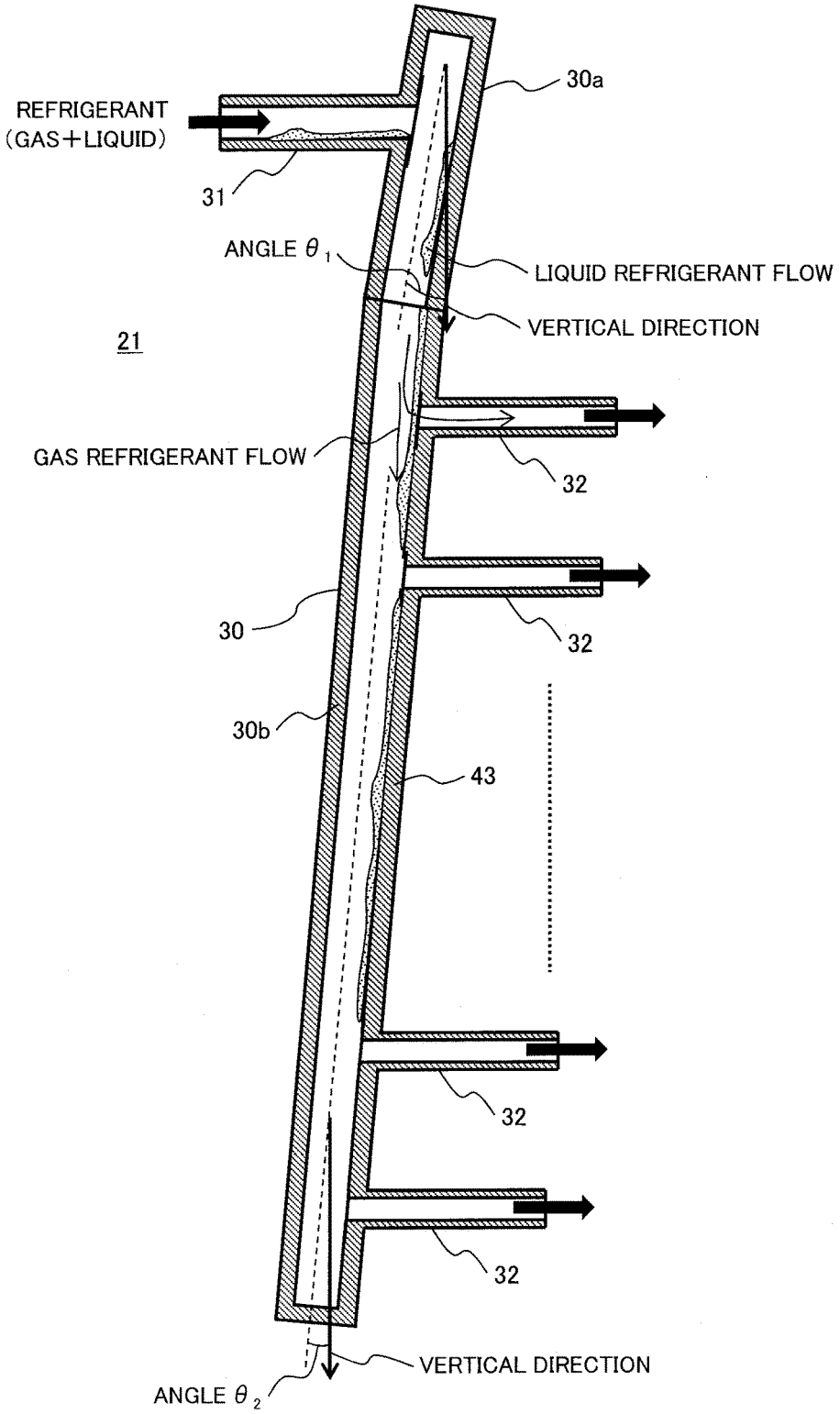
FIG. 7 is a sectional diagram illustrating one example of a refrigerant distributor according to an embodiment 5.

Next, a refrigerant distributor according to a fifth embodiment of the present invention will be described by using FIG. 7. FIG. 7 is a sectional diagram illustrating one example of the refrigerant distributor 21 according to the fifth embodiment. The refrigerant distributor 21 according to the present embodiment is also applicable to at least any of the refrigerant distributors 21 to 24 of the indoor heat exchanger 4 and the outdoor hear exchanger 5 into which the gas-liquid two-phase flow that the gas refrigerant and the liquid refrigerant are mixed together flows. In the following, a case where the fifth embodiment has been applied to the refrigerant distributor 21 illustrated in FIG. 1 will be representatively described.

The refrigerant distributor 21 according to the fifth embodiment basically also has the same configuration as the refrigerant distributor according to the first embodiment which has been described by using FIG. 2. That is, the refrigerant distributor 21 according to the fifth embodiment illustrated in FIG. 7 also includes the header pipe 30, the inlet pipe 31 through which the refrigerant that the gas refrigerant and the liquid refrigerant are mixed together flows in and the plurality of refrigerant pipes 32 through which the refrigerant flows out. The plurality of refrigerant pipes 32 are connected to the other side of the header pipe 30 on the opposite side of the inlet pipe 31, below the inlet pipe 31 in the vertical direction. The inlet pipe 31 and the refrigerant pipes 32 are connected to the header pipe 30 by brazing, welding and so forth so as to form the refrigerant flow path in the inside of the header pipe 30. The inlet pipe 31 is installed above the connection part between each of the plurality of refrigerant pipes 32 and the header pipe 30 on the side opposite to each refrigerant pipe 32.

In the following, points that the fifth embodiment is different from the first to fourth embodiments will be described.

In the present embodiment, the header pipe 30 is configured by a vertical upper side header pipe (an upper side header pipe) 30*a* and a vertical lower side header pipe (a lower side header pipe) 30*b*. The upper side header pipe 30*a* is a header pipe which is installed above the refrigerant pipe 32 located on a vertical uppermost part and the lower side header pipe 30*b* is a header pipe which is installed under the upper side header pipe 30*a*.

As a structure for guiding the liquid refrigerant toward the refrigerant pipe 32 side, in the present embodiment, the upper side header pipe 30*a* is installed toward the one-end side 43 which is the side of the connection part between the refrigerant pipe 32 and the header pipe 30, that is, the inlet side of the refrigerant pipe 32 into which the refrigerant flows from the header pipe 30 with an inclination of the optional angle $\theta_1$ relative to the vertical direction as the reference. The lower side header pipe 30*b* is installed at the angle $\theta_2$ which is larger than about 0° and is smaller than the angle $\theta_1$ relative to the vertical direction as the reference.

The upper side header pipe 30*a* and the lower side header pipe 30*b* may be configured by joining together by brazing, welding or the like or one header pipe 30 may be bent on a part above the uppermost refrigerant pipe 32 so as to form a part corresponding to the upper side header pipe 30*a* and a part corresponding to the lower side header pipe 30*b*. Other configurations are the same as those of the refrigerant distributor according to the first embodiment described in FIG. 2.

The liquid refrigerant which flows through within the header pipe 30 comes to flow more toward the inner wall surface on the inlet side of the refrigerant pipe 32 in the inside of the header pipe 30 than it flows toward other parts by configuring the refrigerant distributor 21 as described in the embodiment 5. Consequently, since the liquid refrigerant comes to be distributed also to the refrigerant pipe 32 connected to the upper part of the header pipe 30, that the liquid refrigerant flows downward in the inside of the header pipe 30 and builds up on the lower part of the header pipe 30 is suppressed and it is possible to improve uneven distribution of the refrigerant into the plurality of refrigerant pipes 32.

Further, in the present embodiment, since the lower side header pipe 30*b* is installed at the angle $\theta_2$ which is larger than about 0° and is smaller than the angle $\theta_1$ relative to the vertical direction as the reference, it is possible to more reduce the installation area than in a case where the entire of the header pipe 30 is installed at the angle $\theta_1$. Accordingly, according to the present embodiment, it is possible to further miniaturize the entire of the heat exchanger and it is possible to improve the degree of freedom of installation of the heat exchanger and the refrigerant distributor.

Although in the above-mentioned fifth embodiment, the inclination angle of the upper side header pipe 30*a* has been set to $\theta_1$ and the inclination angle of the lower side header pipe 30*b* has been set to $\theta_2$ which is larger than about 0° and is smaller than the angle $\theta_1$, the inclination angle of the lower side header pipe 30*b* may be set to about 0°, that is, the lower side header pipe 30*b* may be configured vertically with no inclination.

Taking also a result obtained by the numerical simulation in FIG. 3 described in the first embodiment into consideration, the inclination angle $\theta_1$ of the upper side header pipe 30*a* may be made the same as the inclination angle $\theta$ of the header pipe 30 described in the first embodiment and most preferably, the inclination angle $\theta_1$ may be set to at least about 30° and not more than about 45°. In addition, it is preferable to set the inclination angle $\theta_2$ of the lower side header pipe 30*b* to at least about 0° and not more than about 20° and it is more preferable to set the inclination angle $\theta_2$ larger than about 0° and to not more than about 20°. Thereby, advantageous effects that it is possible to reduce the degree of relative dispersion in amount of the liquid refrigerant to be distributed to the plurality of refrigerant pipes 32 and it is possible to reduce the installation area of the header pipe 30 are obtained.

Incidentally, in the present embodiment, the upper side header pipe 30*a* and the lower side header pipe 30*b* may be connected together simply by making different the inclination angle $\theta_1$ of the upper side header pipe 30*a* from the inclination angle $\theta_2$ of the lower side header pipe 30*b* and a configuration that the inclination angle $\theta_2$ of the lower side header pipe 30*b* is made larger than the inclination angle $\theta_1$ of the upper side header pipe 30*a* is also included in the fifth embodiment.

Sixth Embodiment

Figure 8:
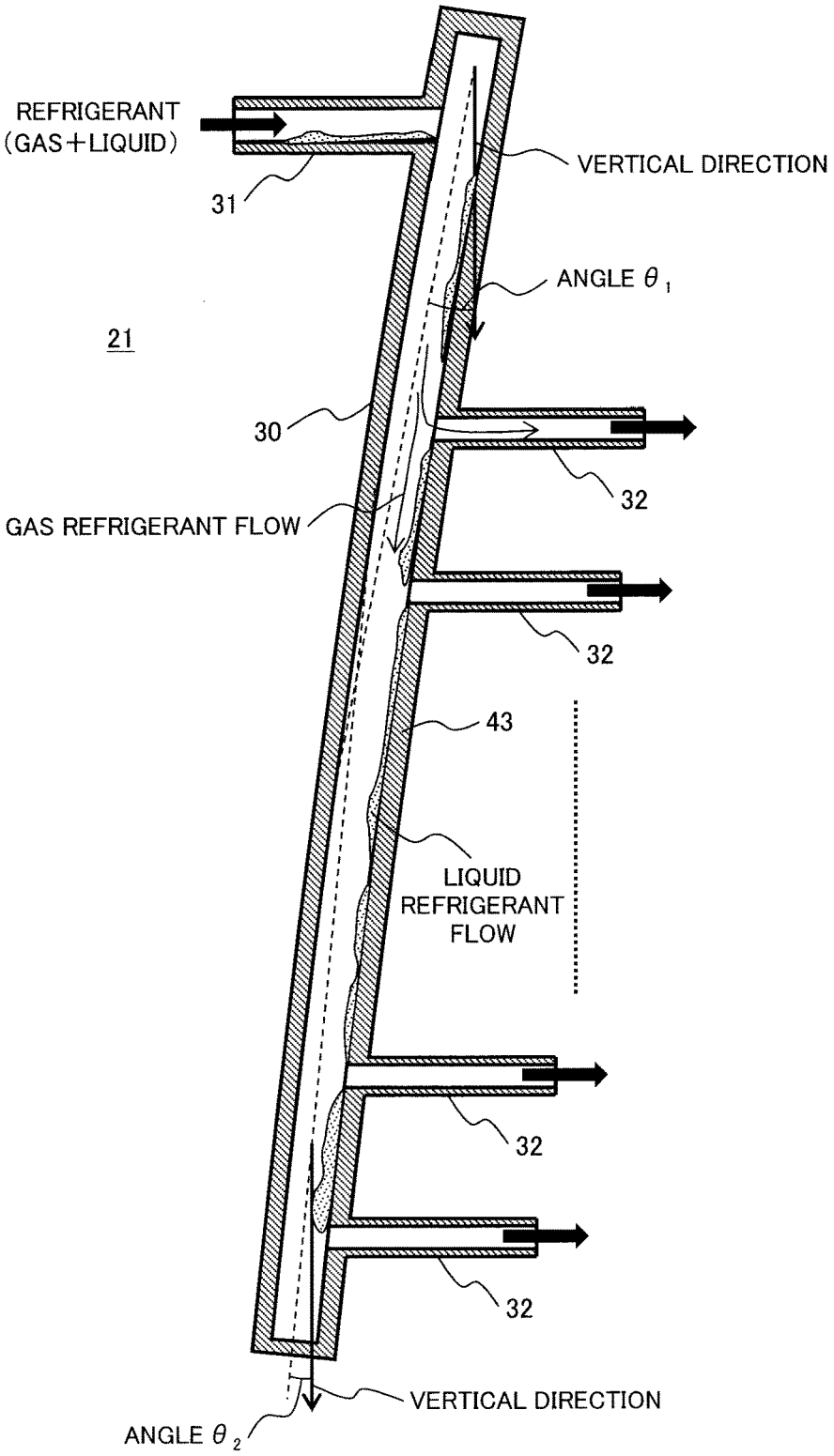
FIG. 8 is a sectional diagram illustrating one example of a refrigerant distributor according to an embodiment 6.

Next, a refrigerant distributor according to a sixth embodiment of the present invention will be described by using FIG. 8. FIG. 8 is a sectional diagram illustrating one example of the refrigerant distributor 21 according to the sixth embodiment. The refrigerant distributor 21 according to the present embodiment is also applicable to at least any of the refrigerant distributors 21 to 24 of the indoor heat exchanger 4 and the outdoor heat exchanger 5 into which the gas-liquid two-phase flow flows similarly to the first embodiment described by using FIG. 1 to FIG. 3 and an example that it has been applied to the refrigerant distributor 21 illustrated in FIG. 1 will be described also in the sixth embodiment.

Since also the refrigerant distributor 21 according to the present embodiment basically has the same configuration as the refrigerant distributor according to the first embodiment described by using FIG. 2, description on the same parts is omitted. In the following, points that the sixth embodiment is different from the first to fifth embodiments will be described.

In the present embodiment, as the structure for guiding the liquid refrigerant toward the refrigerant pipe 32 side, the entire of the header pipe 30 is shaped into the form of a curved pipe. Describing in detail, a vertical upper end side of the header pipe 30 is installed with an inclination of the optional angle $\theta_1$ relative to the vertical direction as the reference toward the one-end side 43 which is the side of the connection part between the refrigerant pipe 32 and the header pipe 30, that is, toward the inlet side of the refrigerant pipe 32 into which the refrigerant flows from the header pipe 30, and a vertical lower end side of the header pipe 30 is installed at the angle $\theta_2$ which is larger than about 0° and is smaller than the angle $\theta_1$ relative to the vertical direction as the reference.

In addition, a part between the vertical upper end side and the vertical lower end side of the header pipe 30 is continuously linked with the vertical upper end side and the vertical lower end side of the header pipe 30 with an optional curvature.

Accordingly, the header pipe 30 in the present embodiment is formed into a curved shape to be made convex upward or into a curved-line shape such as an arc shape and so forth. In addition, as the curved-line shape which configures the header pipe 30, it may be configured by a spline curve, a Bezier curve and so forth. However, the type of curve is not limited to the spline curve and the Bezier curve and the header pipe 30 may be configured by any of other different types of curves.

According to the sixth embodiment, the liquid refrigerant which flows through within the header pipe 30 comes to flow more toward the inner wall surface on the side of the inlet of the refrigerant pipe 32 in the inside of the header pipe 30 than it flows toward other parts, similarly to the first embodiment. Consequently, since the liquid refrigerant comes to be distributed also to the refrigerant pipe 32 connected to the upper part of the header pipe 30, that the liquid refrigerant flows downward in the inside of the header pipe 30 and builds up on the lower part of the header pipe 30 is suppressed and it is possible to improve uneven distribution of the refrigerant into the plurality of refrigerant pipes 32.

Further, according to the sixth embodiment, since the vertical upper end side of the header pipe 30 is installed with an inclination of the angle $\theta_1$ relative to the vertical direction as the reference and the vertical lower end side of the header pipe 30 is installed at the angle $\theta_2$ which is larger than about 0° and is smaller than the angle $\theta_1$ relative to the vertical direction as the reference, it is possible to more reduce the installation area than in the case where the entire header pipe 30 is installed at the angle $\theta_1$ similarly to the fifth embodiment. Accordingly, also according to the present embodiment, it is possible to further miniaturize the entire of the heat exchanger and it is possible to improve the degree of freedom of installation of the heat exchanger and the refrigerant distributor.

In addition, since in the header pipe 30 according to the fifth embodiment, the upper side header pipe 30*a* and the lower side header pipe 30*b* are connected together at different angles with the connection pater interposed, when a difference in angle between the inclination angle $\theta_1$ of the upper side header pipe 30*a* and the inclination angle $\theta_2$ of the lower side header pipe 30*b* becomes large, there is the possibility that flow detachment of the liquid refrigerant which flows downward along the inner wall surface on the inlet side of the refrigerant pipe 32 in the inside of the header pipe 30 may occur at the connection part between the upper side header pipe 30*a* and the lower side header pipe 30*b*. Therefore, there are cases where the amount of the liquid refrigerant which flows downward along the inner wall surface on the inlet side of the refrigerant pipe 32 in the inside of the header pipe 30. In contrast, according to the sixth embodiment, since the respective parts of the header pipe 30 are continuously connected together in the curved shape, there is an advantageous effect that it is possible to suppress detachment of the flow of the liquid refrigerant from the inner wall surface of the header pipe 30.

Incidentally, although in the sixth embodiment, the example that the vertical upper end side of the header pipe 30 is installed with an inclination of the angle $\theta_1$ relative to the vertical direction as the reference and the vertical lower end side of the header pipe 30 is installed at the angle $\theta_2$ which is larger than about 0° and is smaller than the angle $\theta_1$ relative to the vertical direction as the reference has been described, the inclination angle of the lower end side of the header pipe 30 may be set to about 0°, that is, the lower end side of the header pipe 30 may be formed vertically with no inclination.

In addition, the inclination angle $\theta_1$ of the upper end side of the header pipe 30 may be the same as the inclination angle $\theta$ of the header pipe 30 described in the first embodiment. That is, it is preferable that the inclination angle $\theta_1$ of the vertical upper end side be within a range from at least about 10° to not more than about 45°, and it is more preferable that that the inclination angle $\theta_1$ be at least about 30° and not more than about 45°. In addition, it is preferable that the inclination angle $\theta_2$ of the vertical lower end side be at least about 0° and not more than about 20°, and it is more preferable that the inclination angle $\theta_2$ be larger than about 0° and not more than about 20°. Thereby, the advantageous effects that it is possible to reduce the degree of relative dispersion in amount of the liquid refrigerant to be distributed to the plurality of refrigerant pipes 32 and it is possible to reduce the installation area of the header pipe 30 are obtained.

Incidentally, in the sixth embodiment, the example that the vertical upper end side of the header pipe 30 is inclined at the angle $\theta_1$ relative to the vertical direction as the reference and the vertical lower end side of the header pipe 30 is set at the angle $\theta_2$ which is larger than about 0° and smaller than the angle $\theta_1$ has been described. That is, although the example that the header pipe 30 has been formed into the curved-line shape which is made convex upward has been described, the header pipe 30 may be formed into a curved-line shape which is made convex downward. That is, the vertical upper end side of the header pipe 30 may be inclined at the angle $\theta_1$ relative to the vertical direction as the reference, the vertical lower end side of the header pipe 30 may be set at the angle $\theta_2$ which is larger than the angle $\theta_1$ and the part between the vertical upper end side and the vertical lower end side of the header pipe 30 may be continuously linked with the vertical upper end side and the vertical lower end side of the header pipe 30 with the optional curvature.

Incidentally, the present invention is not limited to the aforementioned embodiments and includes various modified examples. In addition, the above-mentioned embodiments have been described in detail for ready understanding of the present invention and the embodiments are not necessarily limited to those including all of the configurations which have been described above.

What is claimed is:

1. A refrigerant distributor, comprising:

an inlet pipe;

a header pipe to which the inlet pipe has been connected; and a plurality of refrigerant pipes connected to one end side of the header pipe which is opposite to the side that the inlet pipe is connected, below the inlet pipe in a vertical direction, and configured such that a refrigerant which has flown into the header pipe through the inlet pipe is distributed into the plurality of refrigerant pipes, wherein the header pipe is arranged such that a vertical upper side of the header pipe is inclined toward the one end side that the refrigerant pipes are connected, includes an upper side header pipe arranged above the refrigerant pipes and a lower side header pipe arranged under the upper side header pipe, and is configured to connect the upper side header pipe with the lower side header pipe by making an inclination angle of the upper side header pipe different from an inclination angle of the lower side header pipe.

2. The refrigerant distributor according to claim 1, wherein the upper side header pipe is arranged with an inclination of an optional inclination angle $\theta_1$ relative to the vertical direction as a reference toward the one end side that the refrigerant pipes are connected and the lower side header pipe is arranged at an inclination angle $\theta_2$ which is smaller than the angle $\theta_1$ relative to the vertical direction as the reference toward the one end side that the refrigerant pipes are connected.

3. The refrigerant distributor according to claim 2, wherein the inclination angle $\theta_1$ of the upper side header pipe is at least about 10° and not more than about 45° relative to the vertical direction and the inclination angle $\theta_2$ of the lower side header pipe is at least about 0° and not more than about 20° relative to the vertical direction.

4. The refrigerant distributor according to claim 3, wherein the inclination angle $\theta_1$ of the upper side header pipe is at least about 30° and not more than about 45° relative to the vertical direction and the inclination angle $\theta_2$ of the lower side header pipe is larger than about 0° and not more than about 20° relative to the vertical direction.

5. A refrigerant distributor, comprising:

an inlet pipe;

a header pipe to which the inlet pipe has been connected; and a plurality of refrigerant pipes connected to one end side of the header pipe which is opposite to the side that the inlet pipe is connected, below the inlet pipe in a vertical direction, and configured such that a refrigerant which has flown into the header pipe through the inlet pipe is distributed into the plurality of refrigerant pipes, wherein the header pipe is arranged such that a vertical upper side of the header pipe is inclined toward the one end side that the refrigerant pipes are connected and the entire of the header pipe is configured into the form of a curved pipe, and a vertical upper end side of the curved-pipe-form header pipe is arranged with an inclination of an optional inclination angle $\theta_1$ relative to the vertical direction as a reference, a vertical lower end side of the header pipe is arranged with an inclination of an inclination angle $\theta_2$ which is smaller than the optional inclination angle $\theta_1$ relative to the vertical direction as the reference, and a section between the vertical upper end side and the vertical lower end side of the header pipe is continuously connected with the vertical upper end side and the vertical lower end side of the header pipe with an optional curvature.

6. The refrigerant distributor according to claim 5, wherein the inclination angle $\theta_1$ of the vertical upper end side of the header pipe is at least about 10° and not more than about 45° relative to the vertical direction and the inclination angle $\theta_2$ of the vertical lower end side of the header pipe is at least about 0° and not more than about 20° relative to the vertical direction.

7. The refrigerant distributor according to claim 6, wherein the inclination angle $\theta_1$ of the vertical upper end side of the header pipe is at least about 30° and not more than about 45° relative to the vertical direction and the inclination angle $\theta_2$ of the vertical lower end side of the header pipe is larger than about 0° and not more than about 20° relative to the vertical direction.

* * * * *